US005398617A

United States Patent [19]

Deandrea

[11] Patent Number: 5,398,617

[45] Date of Patent: Mar. 21, 1995

[54] OVERHEAD RAIL CONVEYOR SYSTEM WITH IMPROVED TRACTION HAVING ELASTICALLY DEFORMING WHEEL OR RAIL PORTIONS

[75] Inventor: Giorgio Deandrea, Rivoli, Italy

[73] Assignee: Fata Automation S.p.A., Turin, Italy

[21] Appl. No.: 160,273

[22] Filed: Dec. 2, 1993

[30] Foreign Application Priority Data

Dec. 3, 1992 [IT] Italy ..... MI92A2764

[51] Int. Cl.[6] ..... B61C 11/04; B61C 15/00

[52] U.S. Cl. ..... 105/29.1; 105/30; 105/73

[58] Field of Search ..... 105/29.1, 30, 73, 127, 105/153

[56] References Cited

U.S. PATENT DOCUMENTS

| | | | |
|---|---|---|---|
| 2,652,785 | 9/1953 | Cox | 105/29.1 |
| 2,655,871 | 10/1953 | Mazzola | 105/30 |
| 3,673,966 | 7/1972 | Wilson | 105/30 X |
| 3,854,418 | 12/1974 | Bertin | 105/29.1 |
| 3,884,153 | 5/1975 | Sugiomoto | 104/93 |
| 4,304,187 | 12/1981 | Becker et al. | 105/29.1 X |

FOREIGN PATENT DOCUMENTS

| | | |
|---|---|---|
| 754766 | 1/1971 | Belgium . |
| 2558852 | 12/1975 | Germany . |
| 2545907 | 7/1977 | Germany . |

*Primary Examiner*—Robert J. Oberleitner
*Assistant Examiner*—S. Joseph Morano
*Attorney, Agent, or Firm*—Finnegan, Henderson, Farabow, Garrett & Dunner

[57] ABSTRACT

A conveyor system for moving loads, comprises including an overhead rail (11, 211) along which run motor-driven carriages (10), each carriage having a motor-driven wheel (13, 113, 213, 313, 413, 513) resting on the upper part of the rail and a frame (12, 15) ending on the lower part of the rail with a device (16) for supporting a load. The wheel (13, 113, 213, 313, 413, 513) has a rolling surface (22, 122, 222, 330) which rolls over a corresponding rolling surface (25, 129, 225) on the rail and also a gripping surface (23, 123, 223, 330) which grips a corresponding gripping surface (24, 128, 224, 324, 424, 524) of the rail. One of the gripping surfaces (23, 123, 223, 330 or 24, 128, 224, 324, 424, 524) has rigid gripping teeth (23, 123, 224, 330, 430, 530), while the other of the gripping surfaces (24, 128, 224, 324, 424, 524 or 23, 123, 223, 330) is made of elastically pliable material in order to receive an imprint of the teeth.

20 Claims, 2 Drawing Sheets

IV
VI
113
122
123
124
128
129
11
211
213
222
223
224
225
313
324
330
413
424
430
513
524
530

OVERHEAD RAIL CONVEYOR SYSTEM WITH IMPROVED TRACTION HAVING ELASTICALLY DEFORMING WHEEL OR RAIL PORTIONS

BACKGROUND OF THE INVENTION

In the technique of overhead rail conveyor systems, of the type for conveying parts along assembly lines, the problems caused by the need to move along sloping sections are well known. In order to prevent any slippage of the driving wheel from leading to erratic or impossible movement on slopes, various solutions have been put forward, the most widely used being those of exerting intense preloading of the wheel by means of pressure rollers acting on the opposite side of the rail, and using racks and toothed wheels. The first solution gives rise to intense friction, which is unjustified when travelling on level sections, and is substantially inefficient for conveying heavy loads, or for steep gradients. The second solution ensures a driving thrust even for the heaviest loads, but presents serious problems at the beginning of upward sloping ramps. In fact, in order to cut costs, the racks are provided only on the sloping sections. Upon reaching the beginning of one of these sections, the toothed wheel therefore has great difficulty in meshing, resulting in wear and considerable noise. The general scope of this invention is to obviate the aforementioned problems by providing an overhead rail conveyor system in which the sloping sections can be easily traversed even with very heavy loads or steep gradients, without problems of fit and with relatively low costs.

SUMMARY OF THE INVENTION

This scope is achieved according to the invention by providing a conveyor system for transporting loads, comprising an overhead rail along which run motor-driven carriages; each carriage comprising a motor-driven wheel resting on the upper part of the rail and a frame ending under the lower part of the rail with means for supporting the load, characterized by the fact that the wheel comprises a rolling surface which rolls over a corresponding rolling surface on the rail, the wheel also comprising a gripping surface which grips a corresponding gripping surface of the rail, one of said gripping surfaces comprising rigid gripping teeth, the other of said gripping surfaces being made of elastically pliable material in order to receive the imprint of said teeth.

BRIEF DESCRIPTION OF THE DRAWINGS

The innovatory principles of this invention and its advantages with respect to the known technique will be more clearly evident from the following description of several possible exemplificative embodiments applying such principles, with reference to the accompanying drawings, in which.

DETAILED DESCRIPTION OF THE INVENTION

Figure 2:
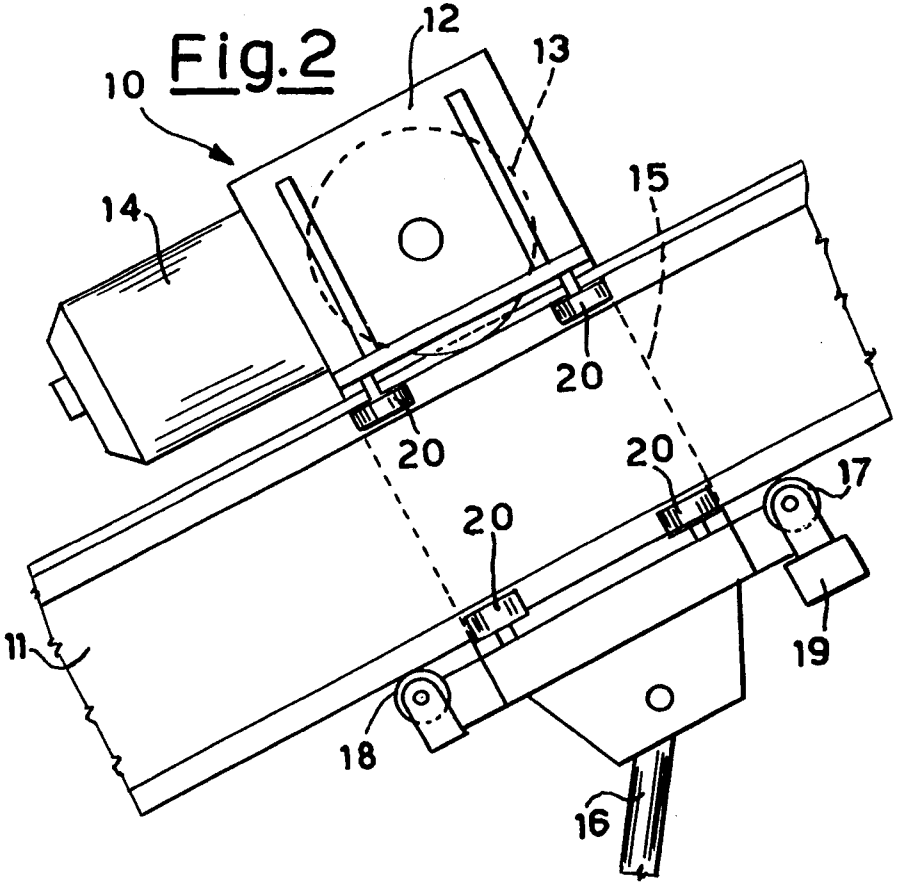
FIG. 2 is a side elevation view of the rail of FIG. 1.
Figure 1:
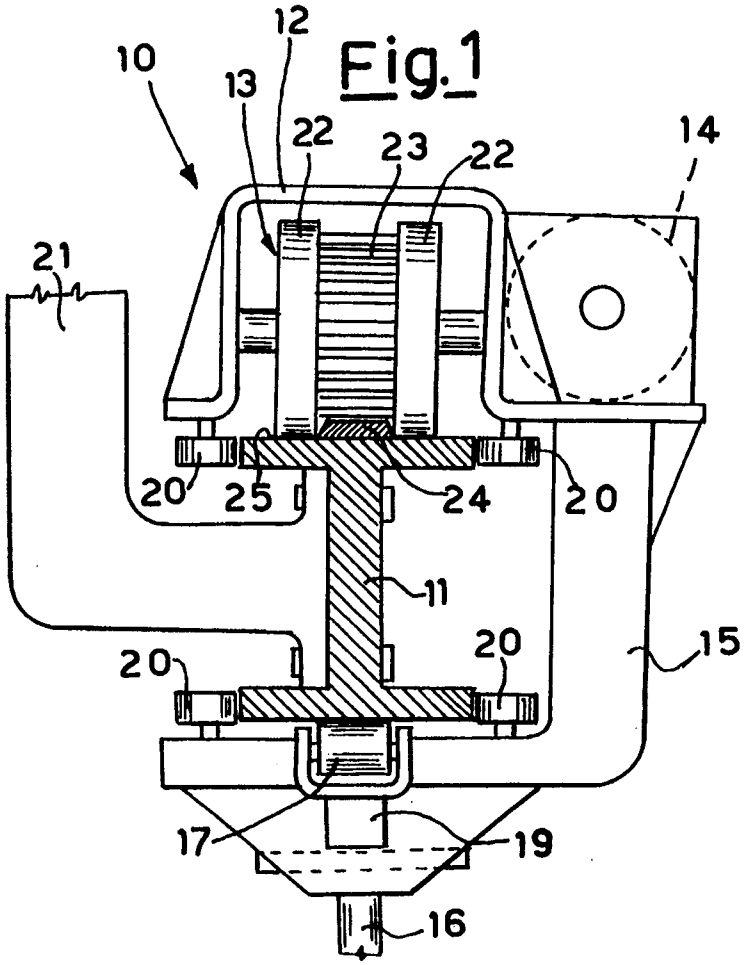
FIG. 1 is a cross-sectional view of a rail with a conveyor carriage according to the invention.

With reference to the figures, FIGS. 1 and 2 show a carriage, generically indicated by reference 10, running along a rail 11 having an I-shaped cross section. The carriage 10 comprises an upper frame 12 rotatably supporting a driving and supporting wheel 13 powered by means of an electric motor 14. Secured to the frame 12 is an L-shaped bracket 15 inferiorly supporting a hook 16 for bearing the load to be conveyed (not shown). The carriage substantially embraces the rail on three sides. The fourth side is provided with supports 21 for supporting the rail.

As can be clearly seen in FIG. 2, the carriage inferiorly supports a pair of pressure rollers 17, 18 adhering to the underside of the rail, one of which can also be pressed by a spring device 19 against the rail. Guide rollers 20 are also advantageously disposed to run along the side edges of the rail.

The description so far is substantially known technique. According to the invention, the wheel 13 comprises a substantially continuous rolling surface 22, to roll along a corresponding rolling surface 25 on the rail, and a gripping surface 23 to grip to the rail in correspondence with a gripping surface 24. Innovatively, one of the two gripping surfaces 23, 24 is elastically pliable so as to receive by impression the shapings of the other corresponding gripping surface. For example, in FIGS. 1 and 2 the wheel has a toothed surface or band 23 while the rail has secured to its upper surface (by glueing, riveting or other known method) a strip 24 of an elastically pliable material, such as for example polyurethane, Vulcolan, or synthetic rubber. Advantageously, the pliable material is preferably elastically pliable in the direction perpendicular to the bearing surface of the wheel, while it is relatively less pliable and deformable in the direction parallel to the movement of the carriage. In this way, as the carriage moves forward the toothed wheel 23 leaves an impression of itself in the strip 24 to form the matching toothing, which disappears once the carriage has passed. This creates a strong grip which enables the carriage to climb steep slopes with very heavy loads, in a way comparable to the use of conventional racks without, however, any problems of engagement and noise. Obviously, whenever friction alone is considered sufficient for level sections, the portion of gripping surface on the rail can be provided exclusively along the sloping sections.

The rolling surfaces and gripping surfaces can be differently shaped and disposed according to the various requirements. For example, in FIG. 1 the rolling surface of the wheel is composed of two smooth lateral bands delimiting a circumferential area or band at the center of the toothed wheel. The central area 23 is enclosed between the rolling areas so as not to touch the rail whenever the gripping area of the latter is not present. The gripping area 24 is made in the form of a strip positioned between the contact areas of the rolling portions of the wheel.

Figures 3, 4, 5, 6, 7, 8, 9:
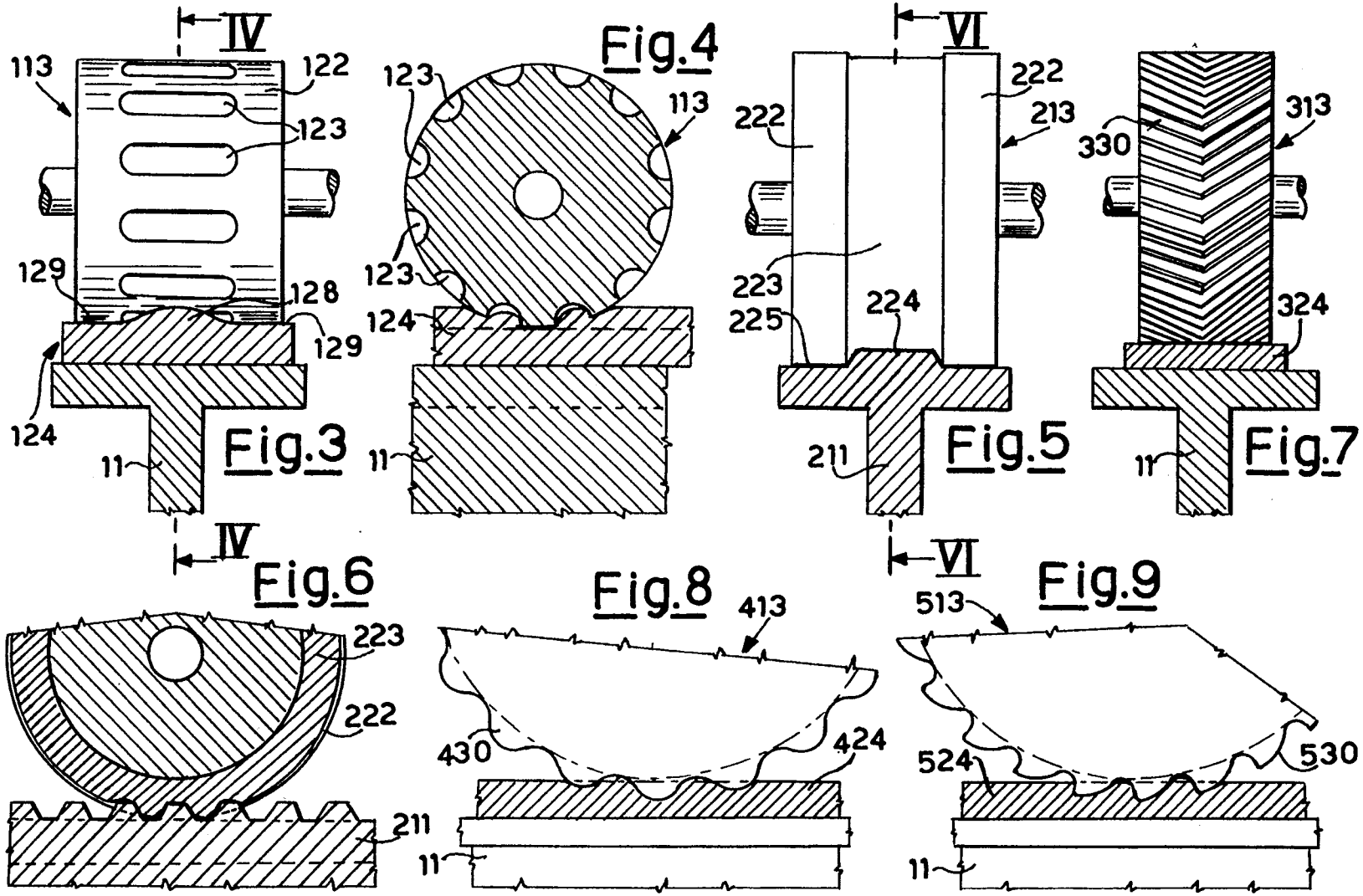
FIG. 3 is a cross-sectional view of a detail of a first embodiment of a rail and driving wheel according to the invention.
FIG. 4 is a sectional view taken along the line IV—IV of FIG. 3.
FIG. 5 is a cross-sectional view of a detail of a second embodiment of a rail and driving wheel according to the invention.
FIG. 6 is a sectional view taken along the line VI—VI of FIG. 5.
FIG. 7 is a cross-sectional view of a detail of a third embodiment of a rail and driving wheel according to the invention.
FIGS. 8 and 9 are partial side elevation views of details of two further embodiments of a rail and driving wheel according to the invention.

FIGS. 3 and 4 show a first possible variant, where the wheel 113 has a rolling surface 122 extending over the entire width and comprising within a central area transversal grooves 123 forming teeth of the gripping surface. The rail is correspondingly covered with a gripping strip 124. Advantageously, the strip is at least equivalent in width to the entire width of the wheel. In correspondence with the gripping area of the wheel, the strip 124 is provided with a hump-shaped protruding area 128 in a crosswise direction to the strip. As the wheel passes over it said area is deformed and fits into the grooves 123 (as can be clearly seen in FIG. 4). On either side of the gripping area the strip 124 is provided with lateral edges or flat supporting surfaces 129. The strip 124 can also be made with variable degrees of pliability so as to be deformable in 128 for gripping, and substantially more rigid in 129 for simply resting. It is obvious that the embodiment of FIGS. 3 and 4 has a larger supporting surface than that of FIGS. 1 and 2, with equivalent wheel size, and consequently has the possibility of carrying heavier loads.

FIGS. 5 and 6 show a second variant, demonstrating that it is not necessary for the rigid portion to be on the wheel and the deformable portion on the rail. In fact, the wheel 213 is made with rigid lateral rolling areas 222, with a pliable area 223 at the center, for example made in the form of a ring of pliable material fitted into an external groove cut along the center of the wheel. The rail 211 is correspondingly provided with indentations 224 which deform the pliable area of the wheel as can be clearly seen in FIG. 6. The lateral portion of the rail comprises rolling areas 225. The toothing can obviously be provided along the system only wherever greater tractive power is required.

As is also shown in FIG. 7, the supporting and gripping surfaces can also blend into one another. In fact, the wheel 313 has teeth 330 extending along its entire outer surface. Said teeth are disposed in herringbone or cuspidal-fashion, in such a way that their apex offers a substantially continuous supporting surface. Thus, when the wheel runs over a pliable strip 324 the teeth 330 produce their gripping imprints, while when they run over the portion of rail without the strip they form a substantially continuous and consequently bounce-free contact surface. The teeth can obviously be provided with other configurations, with which it is possible to obtain substantially continuous rolling surfaces. For example, any disposition of the teeth extending crosswise to the wheel and slanted with respect to its axis of rotation such as for example a helicoidal disposition of the teeth, serves the purpose.

In the various embodiments shown, the cross-section of the teeth need not necessarily be symmetrical or angular. For example, FIG. 8 shows a wheel 413 where the gripping area is composed of undulations 430 that run over a pliable strip 424, while in FIG. 9 the teeth are in the form of serrated teeth 530, with their apex pointed in the opposite direction to the movement of the carriage so as to increase the thrust that run over a pliable strip 524.

At this point it will be clear that the intended scope has been achieved by providing carriages with wheels having a powerful gripping action for their ascending movement.

The foregoing description of embodiments applying the innovatory principles of this invention is obviously given by way of example in order to illustrate such innovatory principles and should not therefore be understood as a limitation to the sphere of the invention claimed herein. For example, the gripping and rolling areas can be made in the form of separate coaxial wheels, for the simple rolling and gripping action, respectively. This wheel assembly is, however, globally indicated herein by the generic term of wheel.

In embodiments such as the one shown in FIG. 7; the imprints are obviously proportional to the loads applied and can, if necessary, be augmented by pressure devices. A supporting wheel disposed at the side of the wheel according to the invention can also be provided, in order to offer support only in the event of insufficient thickness of the gripping surface on the rail. These supporting wheels can also act as a stop to limit the degree of squashing of the deformable strip. In this way, the carriage can be suspended only over the deformable strip whenever the loads are lighter than a given value, and then return to rest on the limit stop wheels when said value is exceeded. This is clearly understandable by comparison between FIGS. 1 and 7.

Lastly, the deformable strip can be envisaged at least partially housed in a groove made in the upper part of the rail, so as to provide the strip with a lateral restraint and ensure that it is secured efficiently.

What is claimed is:

1. A conveyor system for moving loads, comprising an overhead rail, at least one carriage adapted to run along said rail, said carriage having a frame that extends between an upperside and a lower side of the rail, a drive wheel rotatably supported in an upper part of the frame, means for driving said drive wheel along the upperside of said rail and means for supporting a load on a lower part of said frame that extends beneath the lower side of said rail, said drive wheel having on a portion of its peripheral surface at least one rolling surface in rolling contact with a corresponding rolling surface on the upperside of the rail and in another portion of the drive wheel's peripheral surface a gripping surface that grips a corresponding gripping surface on the upperside of the rail as the drive wheel rolls along said rail, one of said gripping surfaces having rigid gripping teeth while the other of said gripping surfaces is made of an elastically pliable material that receives and adopts an imprint of the rigid gripping teeth as the drive wheel rolls along said rail and then resiliently returns to its original shape once the wheel has passed, said corresponding rolling surfaces of said wheel and of said rail being elastically less pliable than said other of said gripping surfaces.

2. The conveyor system of claim 1, wherein the gripping surface having rigid gripping teeth is provided on the drive wheel and the gripping surface of an elastically pliable material is provided on the upperside of the rail.

3. The conveyor system of claim 2, wherein the gripping teeth on the drive wheel are formed by grooves in its peripheral surface.

4. The conveyor of claim 2, wherein the gripping surface on the upperside of the rail is a strip of elastically pliable material secured lengthwise to the rail.

5. The conveyor system of claim 4, wherein the rigid gripping teeth extend around a central portion of the wheel and said wheel has two rolling surfaces located on either side of said teeth that roll on two corresponding rolling surfaces on said rail.

6. The conveyor system of claim 2, wherein said gripping surface on the upperside of said rail comprises a part of a strip of material that is secured lengthwise to the rail and said rolling surface on the upperside of the rail is a further part of said strip that is elastically less pliable than said gripping surface part.

7. The conveyor system of claim 6, wherein said gripping surface part is in a central area of said strip and said rolling surface part is located on either lateral side thereof.

8. The conveyor system of claim 7, wherein said central gripping area extends further above the upperside of said rail than said rolling surface parts on either side thereof, forming a hump extending across said strip.

9. The conveyor of claim 1, wherein the gripping surface having rigid gripping teeth is provided on the upperside of the rail and the gripping surface of an elastically pliable material is provided on the wheel.

10. The conveyor system of claim 1, wherein said gripping surface on the wheel comprises a circumferential band that extends around a central portion of the peripheral surface of wheel.

11. The conveyor system of claim 10, wherein the circumferential band is a ring made of said elastically pliable material.

12. The conveyor of claim 11, wherein said drive wheel has two rolling surfaces located on either side of said circumferential band that roll on two corresponding rolling surfaces on said rail.

13. The conveyor system of claim 10, wherein said circumferential band is smaller in diameter than the diameter of the remainder of the wheel.

14. The conveyor system of claim 1, wherein an apex of the gripping teeth form a substantially continuous rolling surface.

15. The conveyor system of claim 14, wherein the gripping surface having rigid gripping teeth is provided on the drive wheel and said teeth extend crosswise to the wheel and are slanted with respect to the axis of the wheel.

16. The conveyor system of claim 15, wherein the teeth form a herringbone pattern.

17. The conveyor system of claim 1, wherein the rolling surface on the upperside of said rail is the upperside of the rail.

18. The conveyor system of claim 1, wherein the gripping teeth have an undulating profile.

19. The conveyor system of claim 1, wherein the gripping teeth have a serrated profile with an apex pointing in the opposite direction to that of movement of the carriage.

20. The conveyor system of claim 1, including pressure rollers on the carriage that exert pressure on the lower side of the rail.

* * * * *